United States Patent [19]

Becker et al.

[11] 4,072,105

[45] Feb. 7, 1978

[54] LABEL PRINTING AND DISPENSING APPARATUS

[76] Inventors: Werner Becker, Hauptstrasse 26; Kurt Schrotz, Brentanostrasse 29, both of Hirschhorn, Germany, 6932

[21] Appl. No.: 705,162

[22] Filed: July 14, 1976

[30] Foreign Application Priority Data

July 8, 1975 Germany ..... 2530346

[51] Int. Cl.[2] ..... B41F 1/08; B65C 11/00

[52] U.S. Cl. ..... 101/288; 101/316; 156/384

[58] Field of Search ..... 101/287,288, 291, 292, 101/316; 156/384, 577; 197/6.7

[56] References Cited

U.S. PATENT DOCUMENTS

| | | | |
|---|---|---|---|
| 2,205,516 | 6/1940 | Busse | 101/316 |
| 2,265,584 | 12/1941 | Stiegler | 101/316 |
| 3,362,326 | 1/1968 | Delpo et al. | 101/316 |
| 3,798,106 | 3/1974 | Jenkins et al. | 101/316 |
| 3,817,177 | 6/1974 | Van Arnam et al. | 101/288 |
| 3,911,817 | 10/1975 | Becker | 101/288 |

FOREIGN PATENT DOCUMENTS

| | | | |
|---|---|---|---|
| 1,511,884 | 6/1969 | Germany | 101/288 |

*Primary Examiner*—Edgar S. Burr
*Assistant Examiner*—William Pieprz
*Attorney, Agent, or Firm*—Samuelson & Jacob

[57] ABSTRACT

In an apparatus for printing and dispensing labels carried in a label ribbon of indeterminate length, a hand lever is held in a rest position by a return spring and a printing device is coupled with the hand lever for movement toward a label, located on a printing table, upon depression of the hand lever and away from the printing table upon release of the hand lever. A transport mechanism is coupled with the hand lever for advancing the label ribbon by a distance equal to the label spacing on the ribbon each time the hand lever is actuated. A printing device is carried at the free end of a further lever movable in the same plane as the hand lever and normally held stationary by a pawl, the other end of the further lever being coupled with the hand lever through a further spring extending between the hand lever and the further lever. When the hand lever is depressed, the further spring is compressed until a predetermined spring force is attained and the pawl is tripped to enable movement of the printing device toward the printing table and to establish a prescribed minimum printing pressure at the printing table.

5 Claims, 5 Drawing Figures

Figure 1:
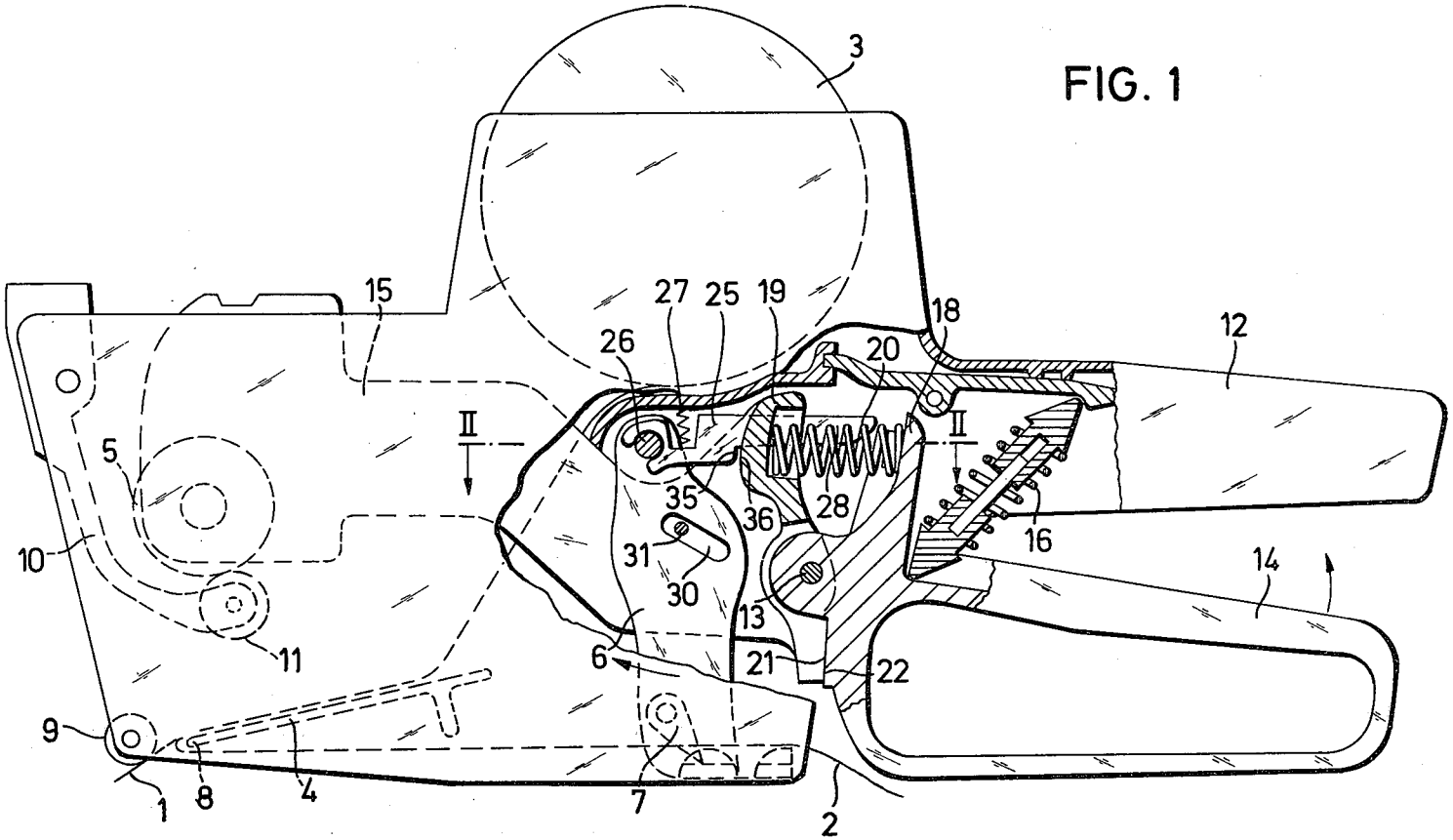

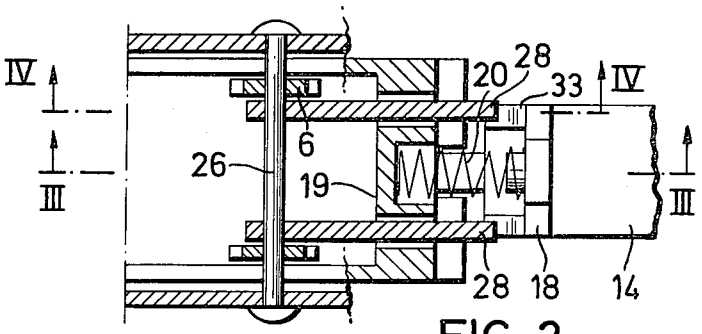
FIG. 2
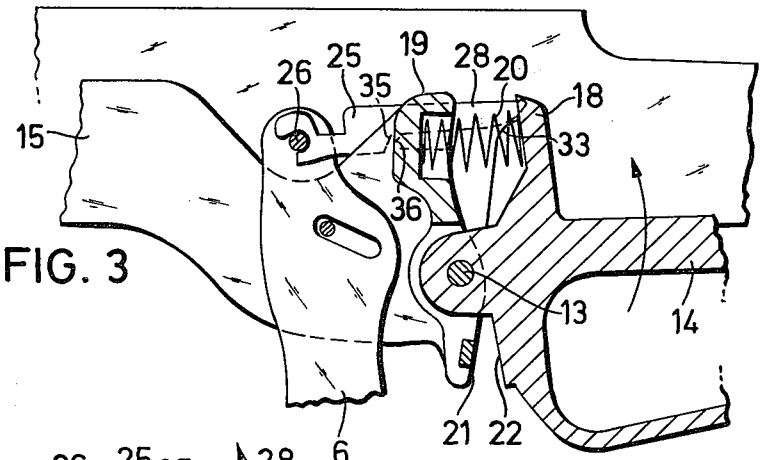
FIG. 3
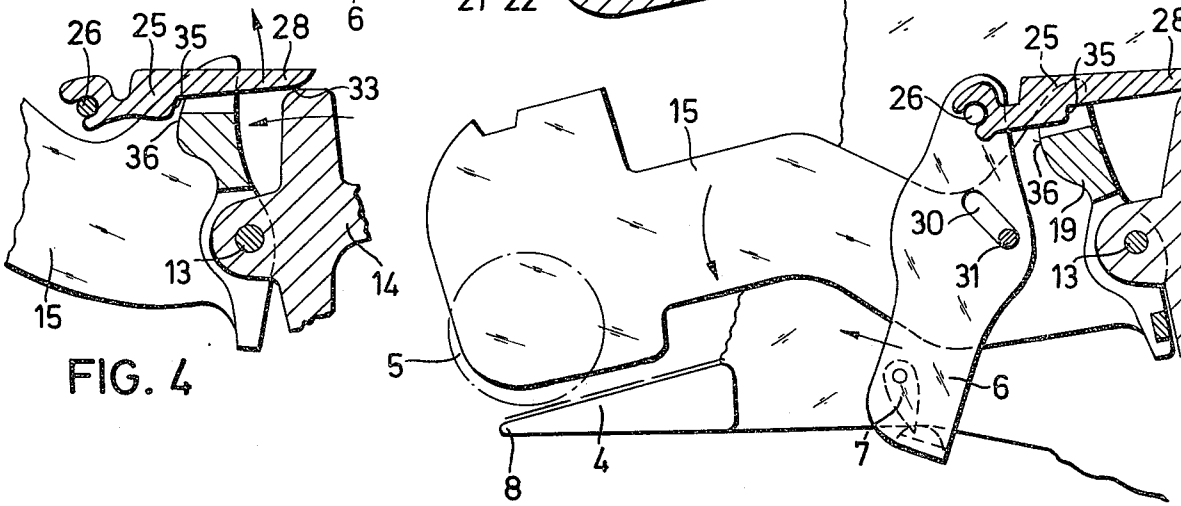
FIG. 5
FIG. 4

LABEL PRINTING AND DISPENSING APPARATUS

The invention relates to an apparatus for printing and dispensing labels carried by a label ribbon for indexing step-by-step along a path of travel through the apparatus by means of a hand lever which is held in a rest position by a return spring, and a printing device coupled with the hand lever which can be moved towards a label present on the printing table by depressing the hand lever, and moved away from the printing table when the hand lever is release. A transport mechanism is coupled with the hand lever and advances the label ribbon by a distance equal to the label spacing on the ribbon each time the hand lever is depressed and released, and a second lever movable in the same plane as the hand lever has a free end carrying the printing device and another end coupled with the hand lever through a spring which bears with one end against the second lever and with the other end against the hand lever. When the hand lever is depressed this spring can be compressed until a spring force has been attained which is higher than the force which opposes movement of the printing device towards the printing table.

Such an apparatus has been disclosed in U.S. Pat. No. 3,911,817. In this known apparatus the force opposed to the movement of the printing device towards the printing table is in principle produced by an inking device acting from underneath and against the printing characters, and this inking device must be swung out of the path of the printing device in order to enable the printing device to be moved against the printing table. The inking device comprises a rocker arm with an ink pad attached to its free end. A spring presses the rocker arm together with the ink pad against the printing characters to be inked. During the printing process the printing device overcomes the spring force and pushes the rocker arm of the inking device out of its path. The mechanics of the inking device are designed in such a manner as to ensure that the resistance offered to the movement of the printing device towards the printing table is at its maximum at the beginning and diminshes with the further movement of the printing device towards the printing table. Since a spring is arranged between the hand lever and the second lever, which carries the printing device, and since this spring can be compressed until it has reached a force higher than the maximum resistance against the movement of the printing device towards the printing table, it is ensured that the impact of the printing device on the printing table and the label to be printed is constant at all times irrespective of the force and the speed with which the hand lever is pulled inwardly.

It is a disadvantage of the proposed apparatus, however, that the impact force of the printing device on the printing table depends on the resistance produced by the inking device against the movement of the printing device towards the printing table. These resisting forces are controlled by the magnitude of the inking force which urges the inking device toward the printing device. In the known apparatus, therefor the spring between the hand lever and the lever which carries the printing device must be matched in accordance with the printing device used in a given case, and, more specifically, with the inking force of the inking device.

The aim of the present invention is to provide an apparatus as described at the beginning in which the maximum resistance opposed to the pivoting of the second lever towards the printing table does not depend on the magnitude of the inking force of the printing device and its inking mechanism.

This aim is achieved by the invention in that the second lever is held captive in its initial position by a pawl which can be desengaged from its locking position by the hand lever when the latter has completed a given distance of its travel and when the spring between the hand lever and the second lever has reached a given force, which pawl automatically resumes its locking position when the hand lever and the second lever have returned to their initial positions.

The provisions made according to the invention ensure that even with an extremely effortless operation of the printing device printing of the labels taken place with the desired intensity and uniformity in each case. The apparatus according to the invention is also independent of the inking force and other characteristics of the inking device associated with the printing attachment. The force with which the spring between the hand lever and the lever with the printing attachment must be compressed in order to ensure a proper printing result can be set to an optimum value so as to achieve a simple, convenient and reliable operation of the labelling apparatus. Since the operating effort required towards the end of the hand lever movement is greatly reduced, there is less fatigue experienced on the part of the operator than with the devices proposed hitherto. Also there is less demand placed upon the operator's attention because it is no longer essential to move the hand lever up to the end of its travel. The hand lever need be moved only as far as is required to lift the pawl out of its locking position. The sequence of all subsequent events in the apparatus takes place automatically, i.e. swinging-out of the inking device, application of the printing device to the printing table, indexing movement of the rocker arm to advance the label ribbon and the return of all these components to their respective initial positions. With this apparatus it is no longer possible for a label to be dispensed unless it has also been printed.

In the following description an embodiment of the invention is explained in greater detail with reference to the accompanying drawing in which:

FIG. 1 is a side view of the labelling apparatus according to the invention, FIG. 2 is a view taken along line II—II in FIG. 1, FIG. 3 is a view taken along line III—III in FIG. 2, FIG. 4 is a view taken along line IV—IV in FIG. 2, FIG. 5 is a side view as in FIG. 1, but with the apparatus in printing position.

In the apparatus shown in FIG. 1 self-adhesive labels 1 affixed in line to a carrier ribbon 2 are on their way along a path of travel from the supply spool 3 to the label output point and are printed en route by a printing attachment 5 movable against the printing table 4; to detach the labels 1 from the carrier ribbon 2 the later is pulled step by step by a transport mechanism comprising a rocker arm 6 and pivoted to it a clamp piece 7, over a reversing device 8. The printed label 1 is a discharge position and with its major portion detached from the carrier ribbon 2, only loosely affixed with its trailing edge whereas its leading edge is underneath an applicator roller 9 with which it can be pressed and rolled on to an object to be labelled.

The printing device 5 is inked by an inking mechanism which includes a pivoting link 10 with an ink pad 11 in the design of a roller arranged at its free end.

The parts of the apparatus required for the printing of the labels as well as those for the step-by-step transport of the labels are accomodated within a housing which presents a fixed grip handle 12 against which a hand lever 14, pivoted about the axis 13, can be moved. The printing device or attachment 5 is supported by a second lever 15 which is also pivoted about the axis 13. Between the hand lever 14 and the grip handle 12 there is a return spring 16 which forces the hand lever 14, the lever 15 with the printing attachment 5 and the rocker arm 6 into their respective neutral or rest positions shown in FIG. 1.

Above their pivot axis 13, the two levers 14 and 15 present arms 18 and 19 facing each other, and arranged between them a compression spring 20. This drive spring 20 forces the lever 15 with its butting face 21, arranged below the pivot axis 13, against the butting face 22 of the hand lever 14, when the hand lever 14 is pulled inward or depressed the compression spring 20 between the two lever arms 18 and 19 is loaded because the pawl 25, which rotates about the pivot axis 26 of the rocker arm 6, and is held captive by the spring 27 in its locking position, prevents the lever 15 from swinging-out towards the printing table. 4.

The pawl 25 extends to form a tongue 28 which projects into the the path of travel along which the hand lever 14 moves so that on completion of a given distance of travel by the hand lever 14 tripping means in the form of cam 33 on hand lever 14 will lift the tongue 28, thereby disengaging the pawl 25 from its locking position. At this moment the spring 20 produces a force which presses the lever 15 with the printing attachment 5 against the printing table 4 while at the same time swinging the inking device 10, 11 out of the way. Simultaneously, a drive pin 31 guided in an inclined slot 30 moves the rocker arm 6 into a pick-up position shown in FIG. 5.

When the hand lever 14 is released the return spring 16 forces the hand lever back into its rest position. At the same time the butting face 22 presses against the butting face 21 of the lever 15 so that the latter will be pushed-up again, and the rocker arm 6 will return to its neutral position shown in FIG. 1. During this process the pawl 25 will be forced by the spring 27 to return from its disengaged position to its locking position.

When the hand lever 14 is depressed as shown in FIG. 3, the slightly prestressed spring 20 is compressed by a given initial amount, and loaded accordingly. In FIG. 3 the hand lever 14 has reached a position in which its cam 33 on the hand lever makes contact with a tongue 28 on the pawl 25.

FIG. 4 shows the hand lever 14 in the position in which the cam 33 pushes the pawl 25 out of its locking position so that the second lever 15 with the printing attachment 5 is free to move in response to the force of spring 20.

During the printing process, i.e. during the downward movement of the lever 15 with the printing attachment 5, the rocker arm 6, which is pivoted about the axis 26, is turned into the pick-up position shown in FIG. 5. When the hand lever 14 is released the drive pin 31 in slot 30 pushes the rocker arm 6 back to its original position shown in FIG. 1. By this movement, the latter pulls along with it the label carrier ribbon 2, clamped between the gripping piece 7 and a counter-face, indexing the ribbon by one label spacing so that the label printed by the printing attachment 5 will be forwarded into the discharge position shown in FIG. 1.

A further advantage of the spring 20 between the hand lever 14 and the second lever 15 in conjunction with the pawl 25 is that also the gripping device operates reliably in each case because the rocker arm 6 is equally under the effect produced by the spring 20 which ensures that it will move without fail into the pick-up position shown in FIG. 5 so that the rocker arm 6 together with its gripping piece 7 will under the control of the return spring 16 pull the carrier ribbon over the reversing edge 8 by precisely one label spacing.

The effort produced by the return spring 16 is obviously higher than that of the spring 20 arranged between the two levers 14 and 15. The pawl 25 is manufactured from plastic and is push-fit on the pivot pin 26 of the rocker arm 6. Since the pawl 25 is pivoted on the side of the lever 15, it is only affected by the compressive load when its projecting portion 35 bears against the abutment 36 of the lever 15.

It may prove a considerable advantage if either the tongue 28 of the pawl 25 or, alternatively, the cam 33 of the hand lever 14 are adjustable. In presetting the tripping moment one can adjust any labelling apparatus to optimum performance, that is to say one can adjust the spring 20 between the two levers 14 and 15 to such a force as to ensure that it is without fail higher than all of the forces opposed to the pivoting of the lever 15, and yet need not be excessively high either. In this way one can also reduce to a minimum the noise associated with the operation of the labelling apparatus. It may on the other hand be equally desirable for the preload of the spring 20 between the two levers 14 and 15 to be variable by means of an adjusting member, e.g. a setscrew. In the same manner it is possible to optimize the force that becomes effective when the pawl 25 is lifted out of its locking position.

We claim:

1. Apparatus for printing and dispensing labels carried on a label ribbon for indexing step-by-step along a path of travel through the apparatus, the labels being printed with a prescribed minimum printing pressure, said apparatus comprising:

a hand lever movable between a rest position and a depressed position;

a return spring biasing the hand lever toward the rest position;

a transport mechanism for moving the label ribbon along said path of travel through increments of advancement corresponding to the spacing of the labels on the label ribbon in response to movement of the hand lever;

a second lever movable between a first position and a second position, the second lever having first and second ends;

a printing table located along said path of travel such that each indexed label is delivered to the printing table;

a printing device carried by the second lever at the first end thereof for movement toward and away from the printing table and the label thereat, in response to movement of the second lever, the printing device being away from the printing table when the second lever is in the first position and being at the printing table when the second lever is at the second position;

an inking device urged against the printing device with a given inking force when the second lever is at the first position, and movable away from the printing device in response to overcoming the given inking force;

coupling means coupling the hand lever with the second end of the second lever, said coupling means including a drive spring between the hand lever and the second end of the second lever, the drive spring being capable of compression in response to movement of the hand lever from the rest position toward the depressed position, relative to the second lever;

a pawl movable between a locking position, wherein the pawl holds the second lever captive in the first position thereof against the force of compression of the drive spring and independent of the inking force during said movement of the hand lever relative to the second lever, and a disengaged position, wherein the second lever is released for immediate movement of the printing device toward the printing table in response to the force of the compressed drive spring;

biasing means urging the pawl into the locking position to maintain the second lever stationary in the first position thereof as the hand lever is moved from the rest position toward the depressed position and the drive spring is compressed; and tripping means on the hand lever for intercepting the pawl during movement of the hand lever from the rest position toward the depressed position, said tripping means moving the pawl from the locking position to the disengaged position when the drive spring has been compressed sufficiently to provide a predetermined force capable of overcoming the given inking force and driving the printing device toward the printing table with sufficient momentum to establish said prescribed minimum printing pressure upon arrival of said printing device at the printing table whereby said prescribed minimum printing pressure is established independent of said inking force.

2. The invention of claim 1 wherein:

the hand lever is mounted for pivotal movement within a plane;

the second lever is mounted for pivotal movement within said plane and includes an abutment at the second end thereof;

the pawl is pivoted about an axis perpendicular to said plane and includes a projecting portion bearing against the abutment of the second lever when the second lever is in the first position and the pawl is in the locking position; and the biasing means includes a spring biasing the pawl into the locking position.

3. The invention of claim 2 wherein:

the tripping means includes a cam movable along a given path of travel in response to movement of the hand lever from the rest position toward the depressed position; and the pawl includes a tongue lying along said given path of travel such that upon compression of the spring between the hand lever and the second lever sufficiently to provide said predetermined force, the cam will engage the tongue and move the pawl from the locking position to the disengaged position.

4. The invention of claim 2 wherein the transport mechanism includes:

a rocker arm mounted for pivotal movement about said axis perpendicular to said plane;

coupling means coupling the rocker arm for pivotal movement in response to movement of the second lever; and means carried by the rocker arm for engaging the label ribbon for indexing the label ribbon through an increment of advancement in response to return movement of the second lever from the second position to the first position.

5. The invention of claim 4 wherein the coupling means coupling the rocker arm for pivotal movement in response to movement of the second lever includes a slot, and a drive pin engaged in the slot.

* * * * *